US012628939B2

(12) United States Patent
Chen et al.

(10) Patent No.: US 12,628,939 B2
(45) Date of Patent: May 19, 2026

(54) MULTIFUNCTIONAL FOLDING TABLE

(71) Applicant: GOLEADER INDUSTRIES (ZHEJIANG) CO., LTD., Jinhua City (CN)

(72) Inventors: Xiaobo Chen, Jinhua City (CN); Peng Pan, Jinhua City (CN); Haihong Gao, Jinhua City (CN); Fengwang Chen, Jinhua City (CN)

(73) Assignee: GOLEADER INDUSTRIES (ZHEJIANG) CO., LTD., Jinhua City (CN)

( * ) Notice: Subject to any disclaimer, the term of this patent is extended or adjusted under 35 U.S.C. 154(b) by 156 days.

(21) Appl. No.: 18/437,390

(22) Filed: Feb. 9, 2024

(65) Prior Publication Data

US 2025/0143445 A1 May 8, 2025

(30) Foreign Application Priority Data

Nov. 2, 2023 (CN) ..... 202311458963.1
Nov. 2, 2023 (CN) ..... 202322972803.0

(51) Int. Cl.
*A47B 3/00* (2006.01)

(52) U.S. Cl.
CPC ..... *A47B 3/002* (2013.01); *A47B 2003/006* (2013.01); *A47B 2200/0035* (2013.01)

(58) Field of Classification Search
CPC ..... A47B 3/002; A47B 3/087; A47B 3/083; A47B 3/0915; A47B 31/04; A47B 1/04; A47B 2003/006; A47B 2200/0035
(Continued)

(56) References Cited

U.S. PATENT DOCUMENTS 2,926,794 A * 3/1960 Karoff ..... A47B 31/04 108/26
5,511,572 A * 4/1996 Carter ..... E04H 15/50 135/145

(Continued)

FOREIGN PATENT DOCUMENTS

CN 209915352 U * 1/2020
CN 217695578 U 11/2022

(Continued)

OTHER PUBLICATIONS

CN209915352 English translation (Year: 2020).*

(Continued)

*Primary Examiner* — Janet M Wilkens
(74) *Attorney, Agent, or Firm* — WARNER NORCROSS + JUDD LLP

(57) ABSTRACT

A multifunctional folding table is provided. The multifunctional folding table includes a table frame assembly having a pair of supporting frames arranged at intervals and a pair of cross frames hinged with each other. Each cross frame is hinged with the corresponding supporting frame. The multifunctional table further includes a table board assembly having at least a main table board hinged between the pair of supporting frames and a pair of side table boards respectively extending away from the main table board from each supporting frame. Each side table board is hinged to the corresponding supporting frame. The main table board and the side table board are synchronously folded towards the supporting frame through a first linkage mechanism.

10 Claims, 10 Drawing Sheets

(58) Field of Classification Search
USPC ..... 108/115, 173, 99, 170, 118, 174, 169, 108/160; 248/439, 188.6
See application file for complete search history.

(56) References Cited

U.S. PATENT DOCUMENTS

| | | | | |
|---|---|---|---|---|
| 6,349,962 | B1 * | 2/2002 | Johanson | B62B 3/02 280/42 |
| 2005/0183640 | A1 * | 8/2005 | Fotia | A47B 3/002 108/115 |
| 2009/0000522 | A1 * | 1/2009 | Collins | B25H 1/04 108/115 |
| 2013/0000528 | A1 * | 1/2013 | Jin | A47B 3/0915 108/127 |
| 2016/0022027 | A1 | 1/2016 | Grace | |
| 2020/0390233 | A1 * | 12/2020 | Leng | A47B 3/0915 |

FOREIGN PATENT DOCUMENTS

| | | | | |
|---|---|---|---|---|
| CN | 219544818 U * | 8/2023 | | B60B 33/00 |
| KR | 102013401 B1 * | 8/2019 | | D06F 57/08 |
| WO | WO-2025119389 A1 * | 6/2025 | | A47B 3/02 |

OTHER PUBLICATIONS

Extended European Search Report for EP24155633.1 dated Jul. 15, 2024, 6 pages.
Machine assisted English translation of CN217695578U obtained from <https://patents.google.com/patent> on Oct. 10, 2024, 4 pages.

* cited by examiner

MULTIFUNCTIONAL FOLDING TABLE

CROSS-REFERENCE TO RELATED APPLICATIONS

This application claims priority to and all advantages of Chinese Patent Application No. 202311458963.1, filed on Nov. 2, 2023, and Chinese Application No. 202322972803.0, filed on Nov. 2, 2023, the contents of which are hereby incorporated by reference.

FIELD

The present disclosure relates to the technical field of outdoor products, in particular to a multifunctional folding table.

BACKGROUND

With the improvement of living standards, people's demand for leisure and entertainment is becoming more and more diversified. Folding tables are widely favored by people because of portability, so as to facilitate outdoor use. Usually, a folding table consists of a table frame, a table board, etc. Most of the existing folding tables are designed to be foldable or unfolded. In an unfolded state, the table board is installed on the table frame by clamping, etc., and the table frame can support the table board to provide a use space, such as placing articles or barbecue with a barbecue oven. In a folded state, the table frame occupies small space and is easy to store. In order to improve the convenience, in some folding tables, the table boards are also designed to be foldable. However, for most forms of the folding tables, such as including multiple table boards, the folding or unfolding of each table board cannot be linked with each other, and the folding or unfolding of the multiple table boards and the table frames cannot be linked with each other either, which is inconvenient to use.

SUMMARY

The purpose of the present disclosure is to propose a multifunctional folding table, which adopts a linkage mechanism to realize the simultaneous folding or unfolding of a table frame and a table board, and can realize the folding or unfolding of some table boards to meet different requirements of outdoor activities, and then improving the use comfort of users.

To this end, the present disclosure provides a multifunctional folding table. The multifunctional folding table comprises a table frame assembly comprising a pair of supporting frames arranged at intervals and a pair of cross frames hinged with each other, and each cross frame being hinged with the corresponding supporting frame; a table board assembly at least comprising a main table board hinged between the pair of supporting frames and a pair of side table boards respectively extending away from the main table board from each supporting frame, and each side table board being hinged to the corresponding supporting frame; wherein the main table board and the side table board are synchronously folded towards the supporting frame through a first linkage mechanism.

According to the above technical concept, the embodiment of the present disclosure may further include any one or more of the following alternative forms.

In some alternative forms, the first linkage mechanism comprises a main table board connecting rod hinged to the main table board, a side table board connecting rod hinged to the side table board, and a sliding sleeve hinged to the main table board connecting rod and the side table board connecting rod, and wherein the sliding sleeve is capable of moving along the supporting frame.

In some alternative forms, the sliding sleeve is limited to the supporting frame through a locking assembly which comprises a limiting pin arranged in the supporting frame and an elastic component matched with the limiting pin, and wherein the locking assembly is configured that: in a locked state, the limiting pin protrudes out of a locking hole for the supporting frame on the supporting frame and a locking hole for the sliding sleeve on the sliding sleeve under the action of the elastic component to implement limiting, and in an unlocked state, the limiting pin biases the elastic component and disengages from the locking hole for the sliding sleeve to enable the sliding sleeve to move along the supporting frame.

In some alternative forms, the multifunctional folding table is further provided with an unlocking assembly which is configured to comprise a thrust rod attached to the supporting frame and an urging component pushed by the thrust rod, and the urging component urges the limiting pin to bias the elastic component.

In some alternative forms, the thrust rod is arranged at the top of the supporting frame and is substantially perpendicular to the supporting frame, and the urging component comprises a connecting rod and a stirring sheet which are arranged in the supporting frame and attached to the thrust rod, and the connecting rod drives the stirring sheet to apply force to the limiting pin to bias the elastic element in response to the downward thrust of the thrust rod.

In some alternative forms, the table board assembly further comprises a pair of lower table boards, and each lower table board is respectively arranged below each side table board and hinged to the corresponding supporting frame, and wherein the lower table board is synchronously folded with the supporting frame and the cross frame through a second linkage mechanism.

In some alternative forms, the second linkage mechanism comprises linkage rods hinged to the lower table board, the supporting frame and the cross frame respectively.

In some alternative forms, the table board assembly further comprises a net frame arranged below the main table board and folded synchronously with the lower table board, the supporting frame and the cross frame through the second linkage mechanism.

In some alternative forms, the second linkage mechanism comprises a main linkage rod hinged to the net frame, the supporting frame and the cross frame respectively, and an adapter rod hinged to the lower table board.

In some alternative forms, the net frame comprises a first net frame and a second net frame, one end of the first net frame toward the second net frame is hinged with one end of the second net frame toward the first net frame, and the other end of the first net frame far away from the second net frame and the other end of the second net frame far away from the first net frame are respectively hinged with the corresponding main linkage rods.

In some alternative forms, the main table board comprises a first main table board and a second main table board, one end of the first main table board far away from the second main table board and one end of the second main table board far away from the first main table board are respectively hinged to the corresponding supporting frames, and the other end of the first main table board toward the second main table board and the other end of the second main table board toward the first main table board are respectively provided with a locking catch and a corresponding locking pin.

The multifunctional folding table disclosed by the present disclosure adopts the linkage mechanism to realize the integral folding or unfolding of the table board assembly and the table frame assembly, which can be quickly folded according to the requirements of transportation or storage without disassembling the table board separately, thus greatly simplifying the folding operation, reducing the packaging volume and facilitating transportation, use and storage. On the contrary, when it needs to be unfolded for use, it can also be unfolded quickly without assembling the table board separately, which improves the comfort of users.

BRIEF DESCRIPTION OF THE DRAWINGS

Other features and advantages of the present disclosure will be better understood by the following alternative embodiments described in detail in conjunction with the accompanying drawings, and the same reference numerals in the drawings identify the same or similar parts.

In the drawings.

DETAILED DESCRIPTION OF EMBODIMENTS

The implementation and use of the embodiments are discussed in detail below. However, it should be understood that the specific embodiments discussed merely exemplify the specific ways of implementing and using the present disclosure, and do not limit the scope of the disclosure. When describing the structural positions of various components, such as the directions of upper, lower, top, bottom, etc., the description is not absolute, but relative. When the various components are arranged as shown in the figures, these directional expressions are appropriate, but when the positions of the various components in the figures would be changed, these directional expressions would also be changed accordingly.

In this context, the expression "comprising" or similar expressions "including", "containing" and "having" which are synonymous are open, and do not exclude additional unlisted elements, steps or ingredients.

In this context, unless otherwise specified, the terms such as "installation", "connection" and "attach" should be understood broadly. For example, it can be fixed connection, detachable connection or integrated; it can be directly connected or indirectly connected through an intermediate medium, and it can be the internal communication of two elements or the interaction between two elements. For those skilled in the art, the specific meanings of the above terms in this context can be understood according to specific situations.

In this context, the terms "first", "second" and so on are not used to limit the sequence and the number of components unless otherwise stated.

It has been realized that, in the existing folding table, it can be only folded or unfolded the table frame while the table board needs to be disassembled or installed separately, or the table board and the table frame cannot be linked with each other during folding or unfolding, resulting in inconvenience in use. According to the concept of the present disclosure, the table board is designed to be hinged with the table frame, and a linkage mechanism is provided, so that when folding or unfolding, the table board can move synchronously with the table frame to realize rapid folding or unfolding without disassembling or assembling the table board separately, thereby simplifying the operation and facilitating the use of users.

Figure 1:
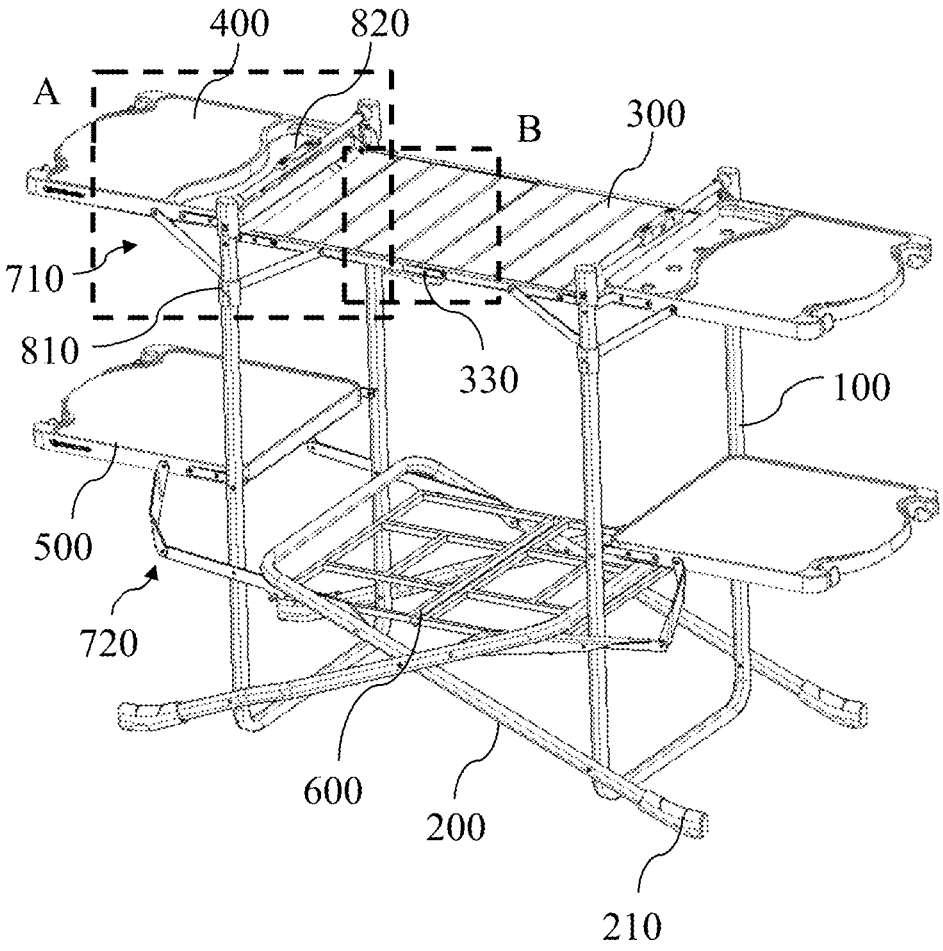
FIG. 1 is a schematic view of a multifunctional folding table in an unfolded state according to an embodiment of the present disclosure.

FIG. 1 shows a multifunctional folding table according to an embodiment of the present disclosure. Generally speaking, the folding table includes a table frame assembly and a table board assembly, wherein the table frame assembly includes a pair of supporting frames 100 arranged at intervals and a pair of cross frames 200 hinged with each other, and each cross frame 200 is hinged to the corresponding supporting frame 100. In the illustrated embodiment, the cross frame 200 is configured as U-shaped and has supporting legs 210 which can provide overall supporting function in an unfolded state or a folded state. The supporting frame 100 is optionally constructed in the form of supporting legs similar to the cross frame, or can be constructed in a generally quadrangular structure as shown in the embodiment, and the supporting function can also be provided through the bottom structure of the supporting frame 100 if the size permits.

According to the present disclosure, the table board assembly at least includes a main table board 300 hinged between the pair of supporting frames 100 and a pair of side table boards 400 respectively extending away from the main table board 300 from each supporting frame 100, and each side table board 400 is hinged to the corresponding supporting frame 100. Alternatively, the main table board can be constructed as a single component, with one end hinged to one supporting frame and the other end clamped to another supporting frame. In some embodiments, the main table board can be configured to include two main table boards attached to each other and hinged to corresponding supporting frames, which will be described in detail below. In some embodiments, the table board assembly further comprises a pair of lower table boards 500, and each lower table board 500 is respectively arranged below each side table board 400 and hinged to the corresponding supporting frame 100. In this way, the folding table provides a plurality of storage table boards to meet different storage requirements of users. In addition, the main table board 300, the side table boards 400 and the lower table boards 500 are all hinged to the supporting frames 100, so when folding or unfolding, it is not necessary to disassemble or assemble each table board separately, but only to synchronously fold each table board relative to the supporting frame 100, which is convenient to operate.

Specifically, in the illustrated embodiment, the main table board 300 and the side table board 400 are folded synchronously toward the supporting frame 100 through a first linkage mechanism 710. The lower table board 500 is folded synchronously with the supporting frame 100 and the cross frame 200 through a second linkage mechanism 720. In this way, the main table board 300 and the side table board 400 of the multifunctional folding table of the present disclosure can be folded to keep the lower table board 500 in the unfolded state according to different requirements. Alternatively, in some embodiments, the main table board and the side table board hinged to one supporting frame can be folded to keep the main table board and the side table board hinged to another supporting frame in the unfolded state.

With reference to FIGS. 1 to 5, in the case that the main table board 300 is configured to include two main table boards attached to each other and hinged to corresponding supporting frames, the main table board 300, the side table boards 400 and the lower table boards 500 can all be considered to include a pair of table boards symmetrically arranged with each other. Similarly, the pair of table boards symmetrically arranged with each other and the corresponding supporting frame all include symmetrical linkage mechanisms. For the sake of brevity, the following detailed description on folding or unfolding is only for one table board and the corresponding linkage mechanism on one supporting frame.

Figure 3:
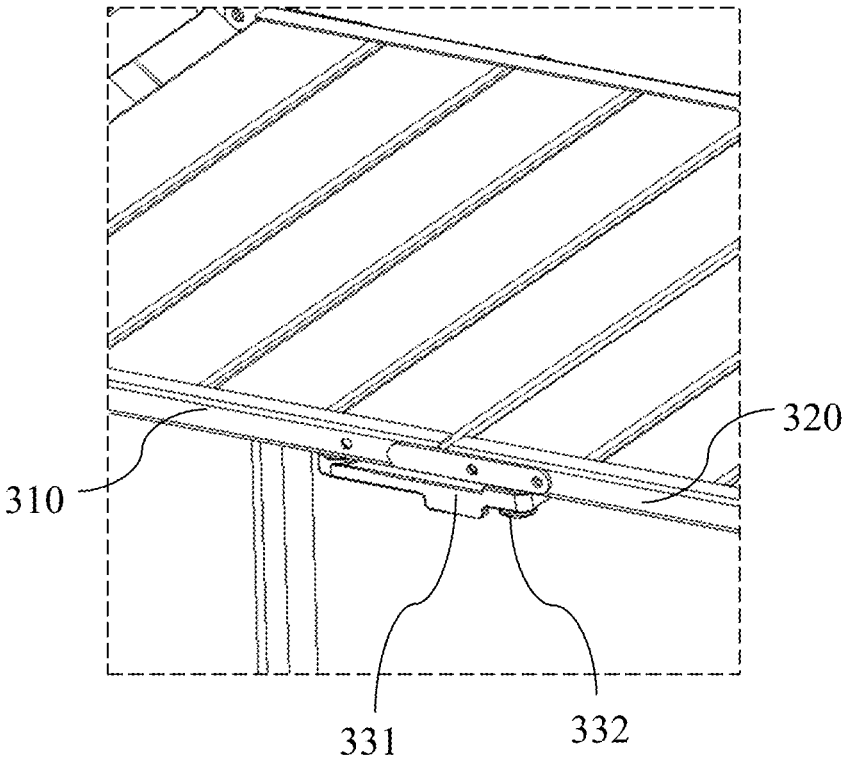
FIG. 3 is an enlarged schematic view of portion B in FIG. 1.
Figure 5:
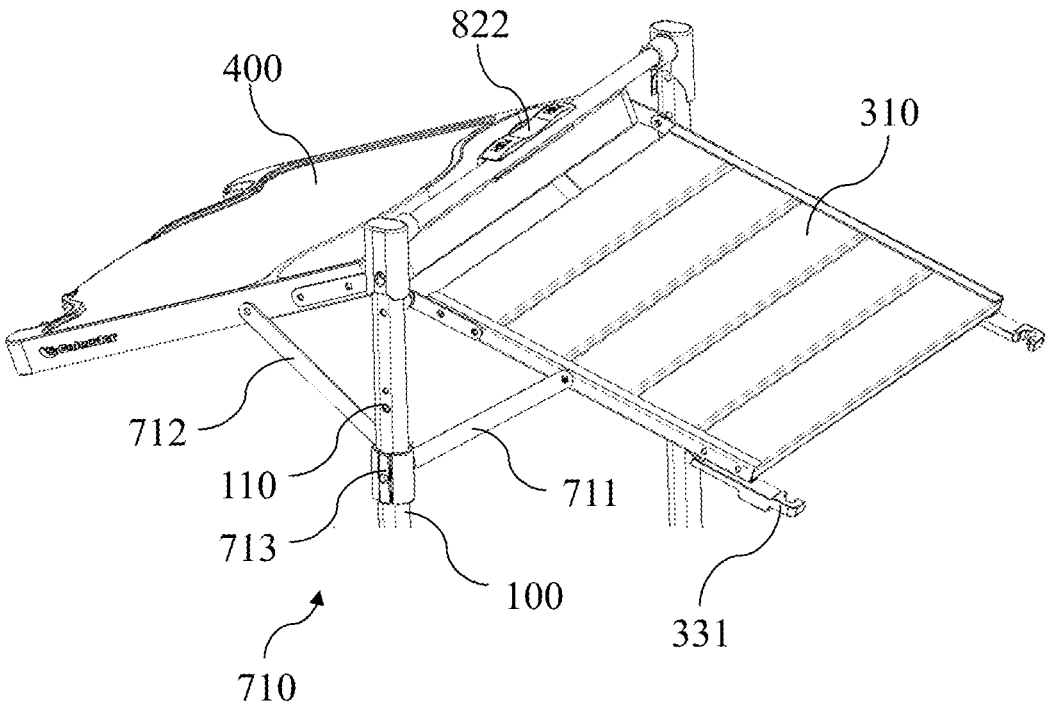
FIG. 5 is an enlarged schematic view of portion C in FIG. 4.

First, referring to FIG. 1, FIG. 3 and FIG. 5, in the embodiment shown, the main table board 300 includes a first main table board 310 and a second main table board 320. One end of the first main table board 310 far away from the second main table board 320 and one end of the second main table board 320 far away from the first main table board 310 are respectively hinged to the corresponding supporting frame 100, and the other end of the first main table board 310 toward the second main table board 320 and the other end of the second main table board 320 toward the first main table board 310 are respectively provided with a locking catch 331 and a corresponding locking pin 332, so as to form a locking assembly 330 for locking the first main table board 310 and the second main table board 320 in the unfolded state. When folding is needed, the locking pin 332 is disengaged from the locking catch 331 to realize folding of the first main table board 310 and/or the second main table board 320.

Figure 2:
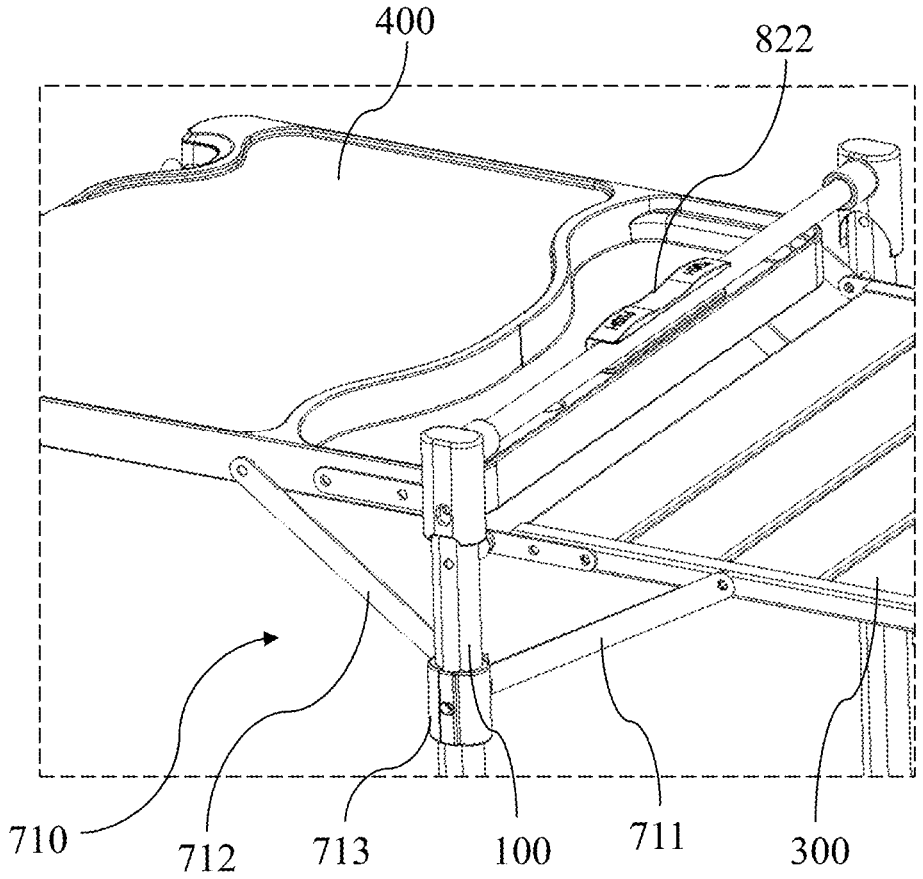
FIG. 2 is an enlarged schematic view of portion A in FIG. 1.
Figure 4:
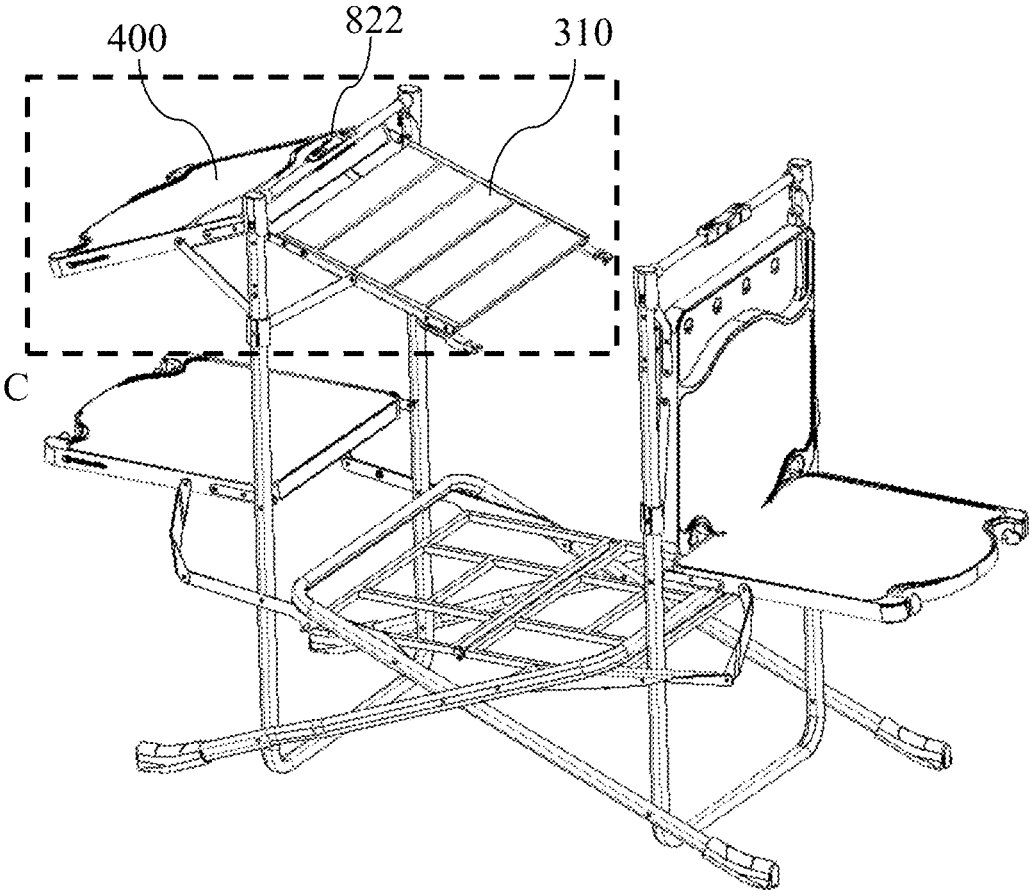
FIG. 4 is a schematic view of the multifunctional folding table, in which a main table board and a side table board hinged to a supporting frame are in a semi-folded state.

As described above, the main table board 300 and the side table board 400 are folded synchronously toward the supporting frame 100 through the first linkage mechanism 710. As shown in FIG. 2, in some embodiments, the first linkage mechanism 710 includes a main table board connecting rod 711 hinged to the main table board 300, a side table board connecting rod 712 hinged to the side table board 400, and a sliding sleeve 713 hinged to the main table board connecting rod 711 and the side table board connecting rod 712, wherein the sliding sleeve 713 can move along the supporting frame 100, so that the main table board 300 and the side table board 400 can be folded or unfolded synchronously with respect to the supporting frame 100, as shown in FIG. 4.

Advantageously, the sliding sleeve 713 is limited to the supporting frame 100 by a locking assembly 810, that is, in the unfolded state, the main table board and the side table board are locked by the locking assembly to facilitate storage and use. Accordingly, when folding is needed, an unlocking component can be used for unlocking so as to facilitate folding of the table board.

Figure 6:
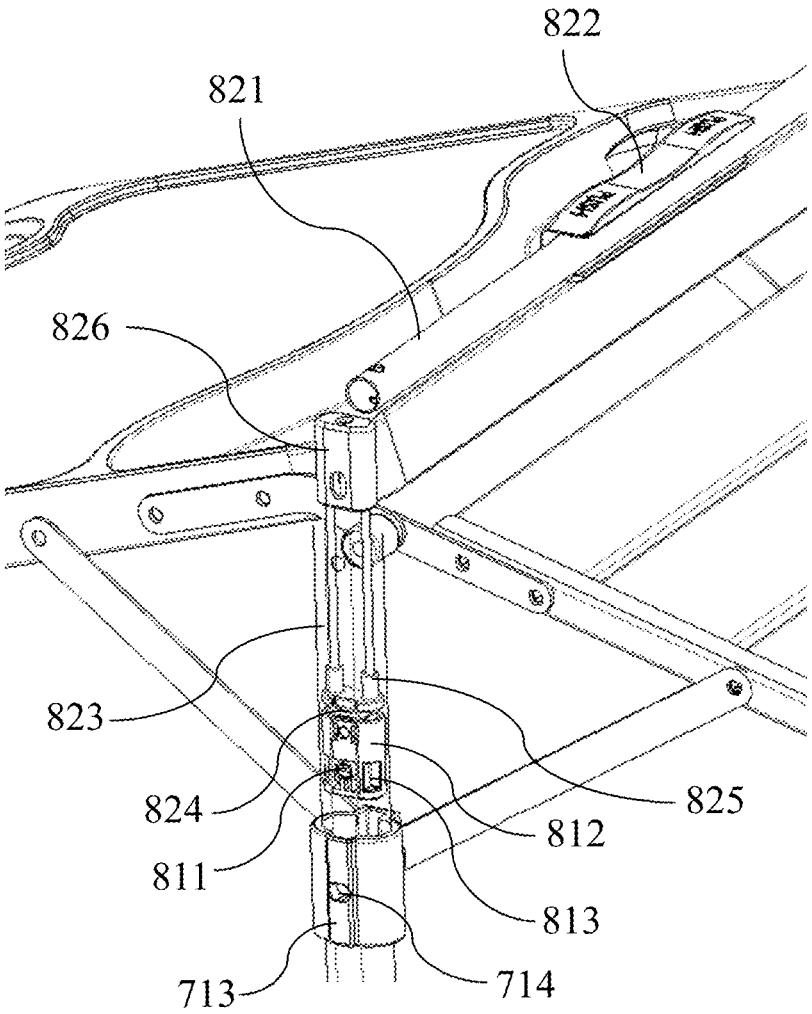
FIG. 6 is similar to FIG. 5, showing a locking assembly and an unlocking assembly of one embodiment.
Figure 10:
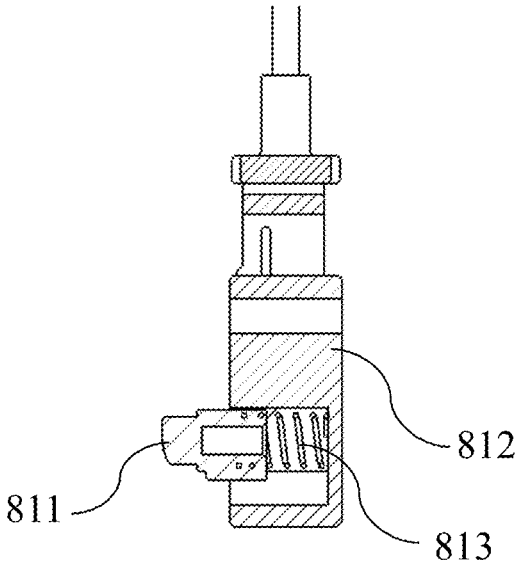
FIG. 10 is a close-up side view of the pin seat, limiting pin, and elastic component.

In some embodiments, combined with FIGS. 5 and 6, the locking assembly 810 includes a limiting pin 811 arranged in the supporting frame 100 and an elastic component 813 matched with the limiting pin 811, and the limiting pin and the elastic component can be arranged in a pin seat 812. The elastic component 813 is shown at the rear side of the limiting pin 811 in FIG. 10. The locking assembly is configured as follows: in a locked state, the limiting pin 811 protrudes out of a locking hole 110 for the supporting frame on the supporting frame 100 and a locking hole 714 for the sliding sleeve on the sliding sleeve 713 under the action of the elastic component to implement limiting; in an unlocked state, the limiting pin 811 biases the elastic component and disengages from the locking hole 714 for the sliding sleeve to enable the sliding sleeve 713 to move along the supporting frame 100. In some embodiments, the unlocking assembly 820 is configured to include a thrust rod 821 attached to the supporting frame 100 and an urging component pushed by the thrust rod 821, and the limiting pin 811 is urged by the urging component to bias the elastic component.

In some embodiments, as shown in FIG. 6, the thrust rod 821 is arranged at the top of the supporting frame 100 and is substantially perpendicular to the supporting frame 100. In order to facilitate the user to apply the thrust, an unlocking button 822 can be provided on the thrust rod 821. The urging component may include a connecting rod 823 and a stirring sheet 824 which are arranged in the supporting frame 100 and attached to the thrust rod 821, so that the connecting rod 823 can drive the stirring sheet 824 to apply force to the limiting pin 811 to bias the elastic component in response to the downward thrust of the thrust rod 821. In some embodiments, a plurality of connecting rods can be provided, such as two as shown in the figure, and each connecting rod 823 can be connected to the stirring sheet 824 through a connecting rod seat 825. In some embodiments, the top of the supporting frame 100 can be provided with an end cover 826. When the thrust rod 821 is pushed downward, it moves along the end cover 826, transmitting the force to the connecting rod 823, and then pushing the stirring sheet 824 through the connecting rod seat 825. As a result, the stirring sheet 824 exerts a biasing force on the limiting pin 811 in the pin seat 812, so that the limiting pin 811 compresses the elastic component and disengages from the locking hole 714 for the sliding sleeve, so that the sliding sleeve 713 is in the unlocked state and can move along the supporting frame 100, specifically move downward. Accordingly, the main table board 300 and the side table board 400 are synchronously folded relative to the supporting frame 100 to the state shown in FIG. 7. Conversely, when the main table board 300 and the side table board 400 are unfolded relative to the supporting frame 100, the sliding sleeve 713 moves upward along the supporting frame 100 until the limiting pin 811 protrudes out of the locking hole 110 for the supporting frame on the supporting frame 100 and the locking hole 714 for the sliding sleeve on the sliding sleeve 713, so that the main table board 300 and the side table board 400 can be restrained and kept in the unfolded state.

Figure 7:
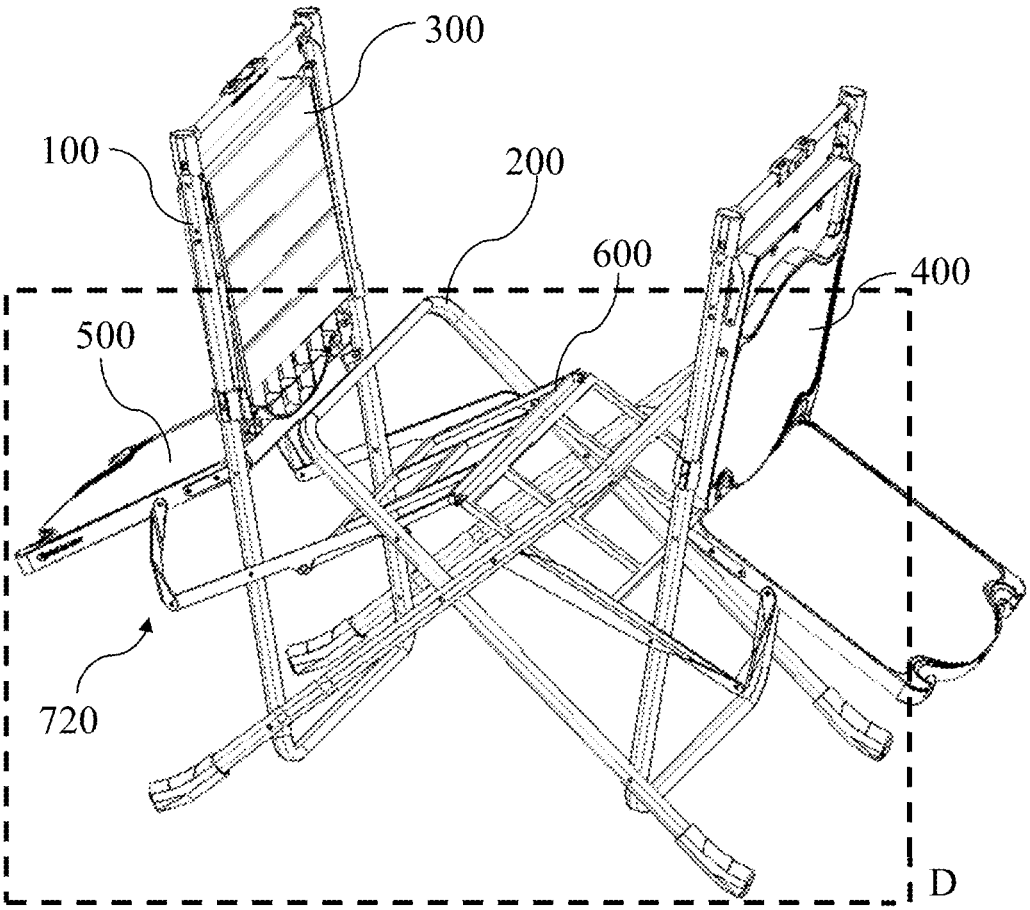
FIG. 7 is a schematic view showing that the main table board and the side table board of the multifunctional folding table are in a folded state, and a lower table board and a net frame are in a semi-folded state.

When the lower table board 500 needs to be folded, the lower table board 500, the supporting frame 100 and the cross frame 200 can be folded synchronously through the second linkage mechanism 720. In some embodiments, the second linkage mechanism 720 includes linkage rods respectively hinged to the lower table board 500, the supporting frame 100 and the cross frame 200. At this time, if the cross frame 200 is lifted or pulled upward as shown in FIG. 7, the lower table board 500, the supporting frame 100 and the cross frame 200 can be folded upward synchronously due to the action of the linkage rods.

Figure 8:
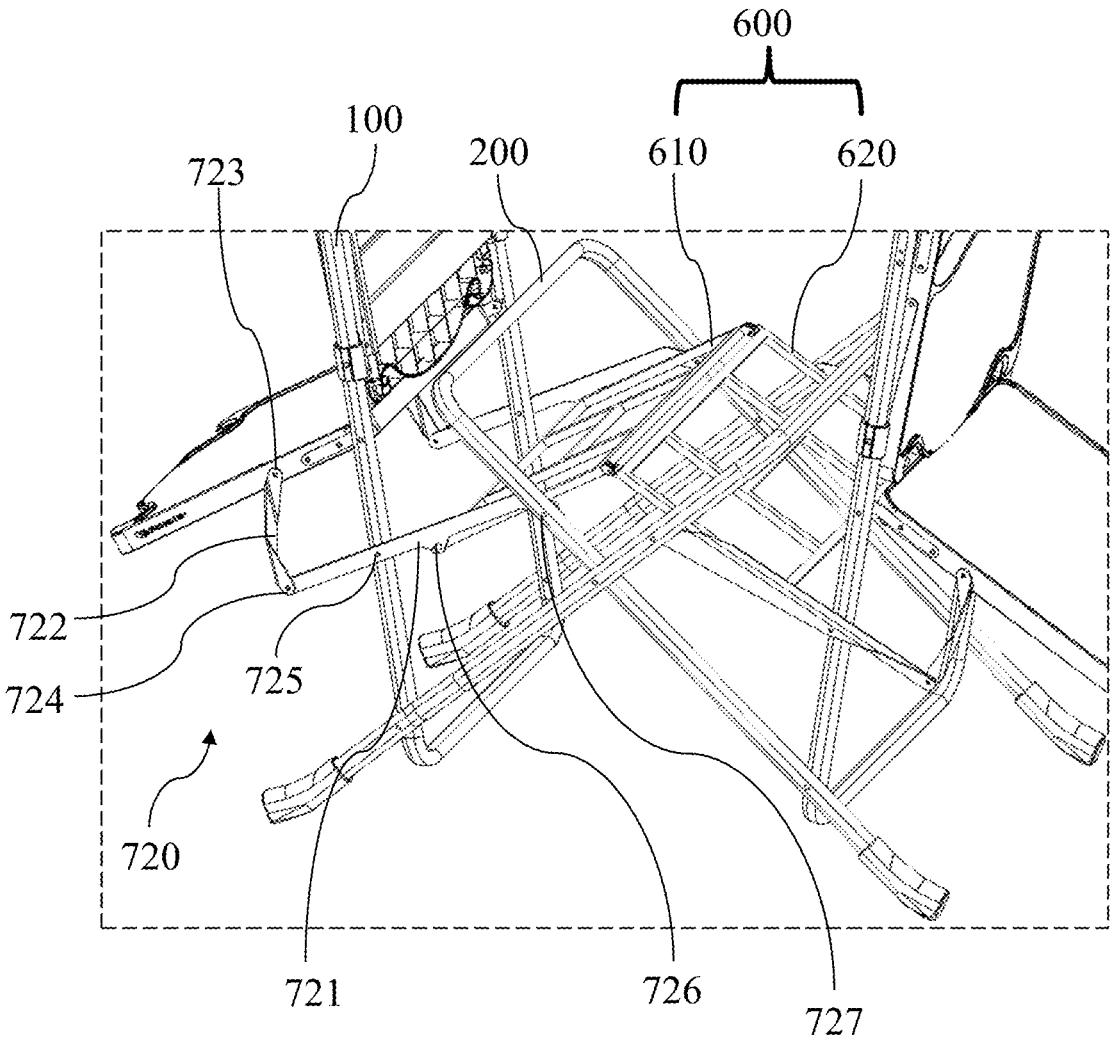
FIG. 8 is an enlarged schematic view of portion D in FIG. 7.

In some embodiments, the table board assembly further includes a net frame 600, which can be arranged below the main table board 300 for placing additional articles, and can be folded synchronously with the lower table board 500, the supporting frame 100 and the cross frame 200 through the second linkage mechanism 720. Referring to FIGS. 7 and 8, the second linkage mechanism 720 includes a main linkage rod 721 hinged to the net frame 600, the supporting frame 100 and the cross frame 200, respectively, and an adapter rod 722 hinged to the lower table board 500. Specifically, the adapter rod 722 is hinged to the lower table board 500 through a first pivot 723 and to the main linkage rod 721 through a second pivot 724, and the main linkage rod 721 is hinged to the supporting frame 100 through a third pivot 725, to the net frame 600 through a fourth pivot 726, and to the cross frame 200 through a fifth pivot 727.

Figure 9:
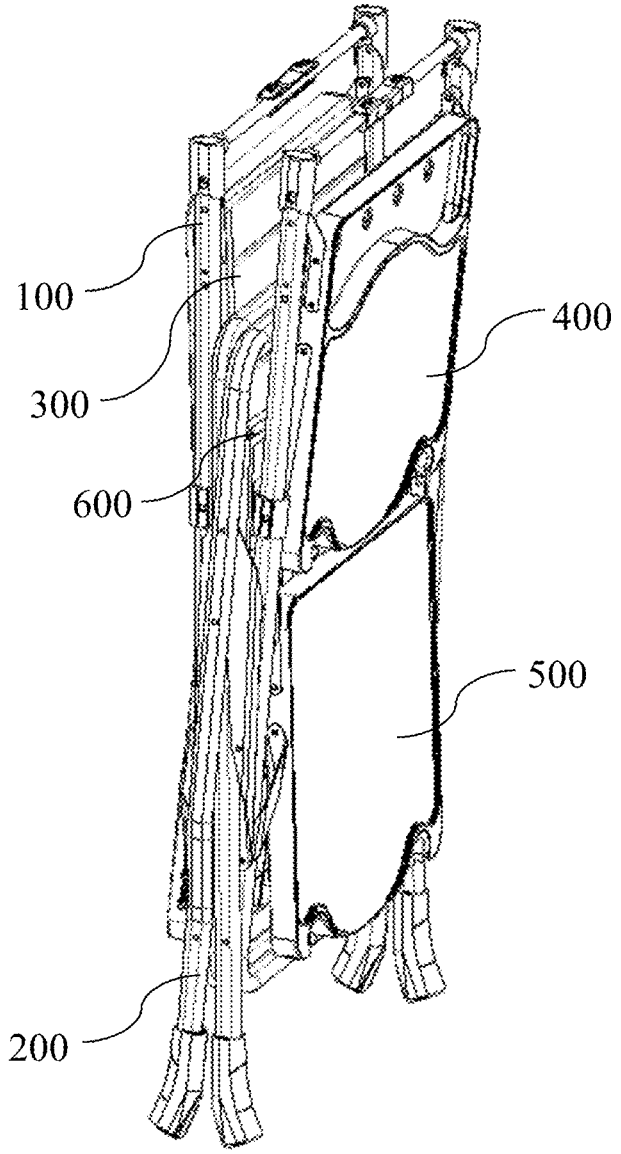
FIG. 9 is a schematic view of the multifunctional folding table in a folded state as a whole.

In some embodiments, the net frame 600 may include a first net frame 610 and a second net frame 620, wherein one end of the first net frame 610 toward the second net frame 620 is hinged with one end of the second net frame 620 toward the first net frame 610, and the other end of the first net frame 610 far away from the second net frame 620 and the other end of the second net frame 620 far away from the first net frame 610 are respectively hinged with the corresponding main linkage rods 721. In this way, when the cross frame 200 linked with the first net frame 610 is lifted upwards, the first net frame 610 folds and drives the second net frame 620 to fold synchronously, and then drives the cross frame linked with the second net frame 620 to fold synchronously, so that the lower table board 500, the supporting frame 100, the cross frame 200 and the net frame 600 can be folded synchronously as a whole, and finally the folding table can be in a completely folded state as shown in FIG. 9.

The multifunctional folding table disclosed by the present disclosure can fold or unfold portion or all of the table boards relative to the supporting frame, thus solving the problem that the existing folding table cannot fold or unfold the table frame and the table boards at the same time, and meeting different functional requirements. In addition, the folding or unfolding process of the multifunctional folding table disclosed by the present disclosure is convenient and rapid, and the table board does not need to be disassembled or assembled separately, so that the folded multifunctional folding table is small in size and easy to store.

It should be understood here that the embodiments shown in the drawings only illustrate the optional architectures, shapes, sizes and arrangements of various optional components of the multifunctional folding table according to the present disclosure; however, it is only illustrative rather than restrictive, and other shapes, sizes and arrangements can be adopted without departing from the spirit and scope of the present disclosure.

The technical content and technical features of the present disclosure have been disclosed above. However, it can be understood that those skilled in the art can make various changes and improvements to the above disclosed concept under the creative idea of the present disclosure, all of which fall within the protection scope of the present disclosure. The description of the above embodiments is illustrative rather than restrictive, and the protection scope of the present disclosure is determined by the claims.

The invention claimed is:

1. A multifunctional folding table, comprising:

a table frame assembly comprising a pair of supporting frames arranged at intervals and a pair of cross frames hinged with each other, and each cross frame being hinged with the corresponding supporting frame;

a table board assembly comprising a main table board hinged between the pair of supporting frames and a pair of side table boards respectively extending away from the main table board from each supporting frame, and each side table board being hinged to the corresponding supporting frame;

wherein the main table board and the side table board are synchronously folded towards the supporting frame through a first linkage mechanism, the first linkage mechanism is locked to the supporting frame through a locking assembly, and wherein the multifunctional folding table further comprises an unlocking assembly which comprises a thrust rod attached to the supporting frame and an urging component, the urging component configured to be pushed by the thrust rod, and the thrust rod is arranged at a top of the supporting frame and is substantially perpendicular to the supporting frame, and the urging component comprises a connecting rod and a stirring sheet which are arranged in the supporting frame and attached to the thrust rod, and the connecting rod is configured to drive the stirring sheet for unlocking the locking assembly in response to the downward thrust of the thrust rod.

2. The multifunctional folding table according to claim 1, wherein the first linkage mechanism comprises a main table board connecting rod hinged to the main table board, a side table board connecting rod hinged to the side table board, and a sliding sleeve hinged to the main table board connecting rod and the side table board connecting rod, and wherein the sliding sleeve is capable of moving along the supporting frame.

3. The multifunctional folding table according to claim 2, wherein the sliding sleeve is limited to the supporting frame through a locking assembly which comprises a limiting pin arranged in the supporting frame and an elastic component matched with the limiting pin, and wherein the locking assembly is configured such that:

in a locked state, the limiting pin protrudes out of a locking hole for the supporting frame on the supporting frame and the limiting pin protrudes out of a locking hole for the sliding sleeve on the sliding sleeve under the action of the elastic component to implement limiting; and in an unlocked state, the limiting pin biases the elastic component and disengages the limiting pin from the locking hole for the sliding sleeve to enable the sliding sleeve to move along the supporting frame.

4. The multifunctional folding table according to claim 3, wherein the connecting rod of the unlocking assembly is configured to drive the stirring sheet to apply force to the limiting pin to bias the elastic component in response to the downward thrust of the thrust rod.

5. The multifunctional folding table according to claim 1, wherein the table board assembly further comprises a pair of lower table boards, and each lower table board is respectively arranged below each side table board and hinged to the corresponding supporting frame, and wherein the lower table board is configured to synchronously fold with the supporting frame and the cross frame through a second linkage mechanism.

6. The multifunctional folding table according to claim 5, wherein the second linkage mechanism comprises linkage rods hinged to the lower table board, the supporting frame and the cross frame respectively.

7. The multifunctional folding table according to claim 5, wherein the table board assembly further comprises a net frame arranged below the main table board and configured to fold synchronously with the lower table board, the supporting frame and the cross frame through the second linkage mechanism.

8. The multifunctional folding table according to claim 7, wherein the second linkage mechanism comprises a main linkage rod hinged to the net frame, the supporting frame and the cross frame respectively, and an adapter rod hinged to the lower table board.

9. The multifunctional folding table according to claim 8, wherein the net frame comprises a first net frame and a second net frame, an end of the first net frame proximate the second net frame is hinged with an end of the second net frame proximate the first net frame, and another end of the first net frame distal the second net frame and another end of the second net frame distal the first net frame are respectively hinged with the corresponding main linkage rods.

10. The multifunctional folding table according to claim 1, wherein the main table board comprises a first main table board and a second main table board, an end of the first main table board distal the second main table board and an end of the second main table board distal the first main table board are respectively hinged to the corresponding supporting frames, and another end of the first main table board proximate the second main table board and another end of the second main table board proximate the first main table board respectively comprise a locking catch and a corresponding locking pin.

* * * * *